US006216824B1

(12) United States Patent
Fuller et al.

(10) Patent No.: US 6,216,824 B1
(45) Date of Patent: Apr. 17, 2001

(54) SEMI-ACTIVE ELEVATOR HITCH

(75) Inventors: James W. Fuller; Randall K. Roberts, both of Amston, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/219,962

(22) Filed: Dec. 24, 1998

(51) Int. Cl.[7] ..... B66B 1/34
(52) U.S. Cl. ..... 187/292; 187/393
(58) Field of Search ..... 187/292, 285, 187/391, 393, 345, 346, 409–411; 318/611, 623

(56) References Cited

U.S. PATENT DOCUMENTS

| | | | | |
|---|---|---|---|---|
| 1,386,253 | * | 8/1921 | Heyl | 187/345 |
| 5,027,925 | | 7/1991 | Kahkipuro | 187/115 |
| 5,542,501 | | 8/1996 | Ikejima et al. | 187/292 |
| 5,635,689 | * | 6/1997 | Shepard et al. | 187/292 |
| 5,750,945 | | 5/1998 | Fuller et al. | 187/292 |
| 5,811,743 | * | 9/1998 | Kohara et al. | 187/393 |
| 5,824,975 | * | 10/1998 | Hong | 187/292 |
| 5,852,264 | * | 12/1998 | Muller | 187/292 |
| 5,862,888 | * | 1/1999 | Iwakiri et al. | 187/345 |
| 5,896,949 | * | 4/1999 | Hamdy et al. | 187/292 |
| 5,929,399 | * | 7/1999 | Jamieson et al. | 187/391 |

* cited by examiner

*Primary Examiner*—Jonathan Salata
(74) *Attorney, Agent, or Firm*—Stephen A. Schneeberger; Ronald G. Cummings

(57) ABSTRACT

A system is provided for the semi-active damping of oscillations during vertical motion of an elevator car relative to a desired trajectory along a relatively lengthy elevator travel path. The elevator car is connected to a motor-controlled support rope in a manner allowing limited relative vertical motion therebetween. A soft spring and a controllable damping means are connected in parallel between the rope and the elevator car. The damping means may be a hydraulic piston and cylinder arrangement controlled via a variable orifice valve. The spring may be a gas-pressurized accumulator connected to the hydraulics of the damping means. A control system provides a motion command signal to control the motor for motion control and the variable orifice valve for damping oscillations. Full closure of the variable orifice valve effectively locks the damping means to maintain a position when the elevator car is braked, and a tension release control gradually releases any accumulated tension across the valve when the brake is released.

11 Claims, 4 Drawing Sheets

SEMI-ACTIVE ELEVATOR HITCH

TECHNICAL FIELD

This invention relates to elevator motion control and more particularly to a semi-active elevator hitch for improved elevator motion control.

BACKGROUND

Elevators are controlled to follow a flight (travel) profile which minimizes travel time within certain jerk, acceleration, and velocity constraints. The constraints are selected to ensure a comfortable ride. In practice, elevator vertical motion includes oscillations about the nominal trajectory (profile) that reduce ride comfort. These oscillations are primarily due to various spring/mass oscillation modes of the compliant rope between the elevator motor and the car. These oscillation modes are very lightly damped and thus can be set in motion by small disturbances that occur in flight. These small disturbances include passenger motion, rail joints, mechanical wear, torque ripple produced by the drive and motor, air pressure changes due to passing floor sills, other cars, and structural members in the hoistway, etc.

Elevator motion control is the mechanism by which the elevator is made to follow the nominal travel trajectory. Elevator motion control is typically accomplished using an elevator motion controller. In the elevator motion controller, the nominal profile to be followed by the elevator is input in terms of a dictated velocity of the elevator car along the profile. The dictated velocity is used to form the nominal commanded speed for the elevator motor. Near the end of flight, the position of the elevator car is measured and used to determine a distance to go estimate which is used to determine a correction to this nominal velocity command to ensure that the elevator lands (arrives and stops) at its desired destination in a smooth and controlled manner within a desired landing accuracy.

The motion controller typically includes a machine room motor velocity controller, which provides feedback of motor or sheave velocity in order to implement the motion command. The feedback of motor velocity to motor torque provides co-located damping of the oscillatory modes so that they are more quickly attenuated. In general, there will be some error in following the nominal profile because the oscillations are not attenuated as much as desired. The error is most critical at the end of the flight, where the error is termed "leveling error". The tracking and leveling errors decrease with the bandwidth of the motion control feedback loop and increase with acceleration and deceleration levels. Currently, the bandwidth is limited by the propagation delay through the rope.

In tall buildings, trajectory-following errors are worse because the long hoist rope is more compliant and there is a considerable time delay for the transmission of a motor motion perturbation in the machine room to propagate down the rope to the car. The speed of this tension wave in a typical elevator rope is 2500 to 3500 meters/sec. Thus there is approximately a 0.1 sec delay for a perturbation in the machine room to propagate to the car if the car is 300 meters below the machine room. The presence of this time delay in the motion control feedback loop limits its bandwidth, which limits how quickly the controller reacts to errors in following the nominal flight trajectory and to disturbances. This limitation has two impacts: (1) the elevator vertical oscillations cannot be as well attenuated; and (2) the accuracy to which the car can be made to follow a decelerating trajectory decreases. The taller the elevator rise, the greater the impact of time delay. To maintain accuracy at landing (e.g., to minimize leveling errors), the deceleration rate of the car has to be reduced for tall buildings. This increases floor-to-floor flight time and is therefore undesirable. Therefore, a need exists for an improved elevator motion controller which improves the attenuation of oscillations, without increasing travel times, particularly in buildings with long elevator shafts.

To accurately land, the elevator motion control needs to include some degree of position error feedback. A common way to accomplish this is to make the dictated velocity a function of distance-to-go. Although position feedback is needed to land accurately, it reduces the damping of the oscillatory modes. It is known that a high position gain (i.e., the slope or gain of a dictated speed vs. distance-to-go function) can cause instabilities. It is also known that lowering position gain increases flight time. The degree of position error feedback that can be allowed increases with the damping of the oscillatory modes. It is further known in the art that car acceleration feedback to the velocity command (provided to a drive and brake subsystem) increases this damping in modest size buildings. In tall buildings, this is not effective because of the relatively large time delay in propagating motion from the main motor to the car. Therefore, there further exists a need for improved attenuation of oscillations for improved position error feedback control.

In U.S. Pat. No. 5,750,945 there is described an elevator motion control system which compares a dictated travel path signal, indicative of a desired elevator travel profile, with a measured travel path signal, indicating actual elevator motion, and provides a motion command signal to appropriate circuitry. The frequency of the motion command signal is split into high and low frequency components, and an active force actuator, located at the elevator car, is used to implement the high frequency/low stroke portion of the motion command signal, while the elevator motor is used to implement the low frequency/high stroke portion of the motion command signal.

The active force actuator is located together with a passive damping device between a hitch and an elevator car frame or between the frame and the car. The active force actuator, or actuators, may be electromagnetic voice coils, the extension and contraction of which are provided by control signals applied thereto, or they may be hydraulic actuators, rotary motors with lead screws, or other suitable devices. In each instance the actuator is actively controlled in both directions, i.e., extension and retraction, to improve the vertical motion control of the elevator along its travel path. Such active control enables the actual motion of the elevator to closely track the elevator vertical travel command signal, by compensating for delays occasioned by the length of the elevator rope. However, the energy source for the respective active actuator typically includes a motor, a pneumatic or hydraulic pump, or a large electrical coil located on the elevator car to drive the respective actuator in both directions. Such arrangements typically are relatively heavy, noisy, and/or costly and may have limited reliability, thus creating a limitation to their overall usefulness in this particular environment. Therefore, there exists a need for further improvement in the type and control of the actuator associated with the elevator car and hitch for damping elevator car vertical oscillations.

DISCLOSURE OF INVENTION

The present invention provides a system for the damping of oscillations during vertical motion of an elevator car position along an elevator travel path in a manner which is relatively less costly, heavy and/or noisy than the active hitch system previously described. The present invention may also represent increased reliability.

Accordingly the present invention relates to a system for the semi-active damping of oscillations during vertical motion of an elevator car position along an elevator travel path. The elevator car is connected by a rope to a sheave mounted to an elevator motor. The rope is connected to the car in a manner permitting limited relative vertical motion therebetween. The semi-active damping system provides a motion command signal corresponding with an elevator travel profile dictated by a desired destination of the elevator along its travel path; spring means effectively connected between the rope and the elevator car to provide a vertical spring force therebetween; controllable damping means effectively connected between the elevator car and the rope in parallel with the spring means and being responsive to a damping command signal for selectively impeding relative vertical displacement between the elevator car and the rope; means for providing a signal indicative of the measured vertical velocity of the elevator car; and control means responsive to the motion command signal and to the car velocity signal for providing a damping command signal to selectively activate the controllable damping means.

The spring means has a spring constant that is sufficiently low, or relatively soft, so as to ensure that relative vertical travel of the elevator car and the relative vertical travel between the elevator car and the rope remain in phase with one another at the relatively low frequency of elevator car and rope oscillations. In some instances, that spring constant may be less than one-half the spring constant of the rope. The spring means may comprise a hydraulic accumulator or the like.

The controllable damping means may comprise one or more hydraulic piston and cylinder combinations operatively connected between the elevator car and the rope, as via a hitch assembly having a support member interconnected to the elevator car and a hitch plate engaged by the rope and movable relative to the support member. A hydraulic circuit supplies fluid to and from the cylinder on both sides of the piston via a variable orifice valve. The valve orifice is regulated by a small control motor or the like, by the damping command signal to controllably impede relative motion between the elevator car and the rope.

The control means of the system may be further responsive to an elevator brake signal to provide a limit damping command signal which ensures that the controllable damping means applies a limit damping force sufficient to prevent relative vertical motion between the elevator car and rope. The control means further may be responsive to the release of the brake signal and to the existence of a signal indicative of a pressure difference across the variable orifice value to provide an initial tension release signal for controlling the rate at which the limit damping force is released.

The above-identified damping system is semi-active in that it resists unwanted oscillations without the requirement for active actuators operating between the elevator car and the ropes which would otherwise require pumps, motors or other large powered actuator drives at the elevator car. The replacement of such active drivers with the present system contributes to quieter, less costly and/or more reliable operation.

The foregoing features and advantages of the present invention will become more apparent in light of the following detailed description of exemplary embodiments thereof as illustrated in the accompanying drawings.

BEST MODE FOR CARRYING OUT THE INVENTION

The present invention provides a significant improvement in the motion control of an elevator by using a semi-active elevator hitch for interconnecting either an elevator car to a main rope or the elevator cab to the elevator frame. The semi-active elevator hitch includes semi-active damping devices acting in parallel and/or in series with passive spring devices and provides improved ride quality and flight time of an elevator, particularly in tall buildings.

Figure 1:
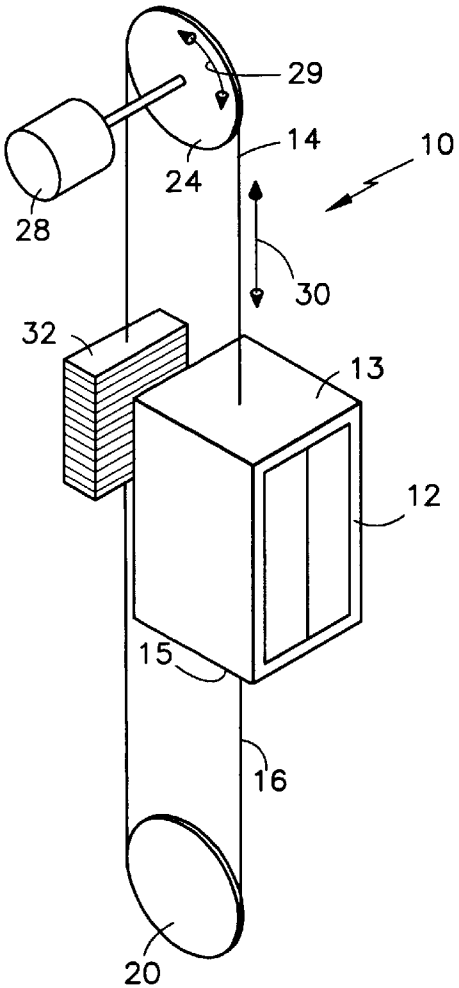
FIG. 1 is a schematic diagram of an elevator.

Referring to FIG. 1, as is known in the art, an elevator 10 includes an elevator car 12 connected at one end 13 to a main rope 14 and, although not necessarily, at the other end 15 to a compensation rope 16 within an elevator shaft (not shown). The compensation rope 16 is received around a compensation pulley 20 and the main rope 14 is received around a sheave 24, e.g., torsion sheave. The sheave 24 is interconnected to a motor 28, e.g., an electric motor or a hydraulic motor, for rotational movement of the sheave 24. Rotational movement 29 of the sheave 24 is translated into longitudinal movement 30 of the elevator car 12 via the main rope 14. As is known in the art, a counterweight 32 may be provided for countering the weight of the elevator car 12. It will be understood by those skilled in the art that the elevator configuration of FIG. 1 is provided to illustrate the general environment of the invention, and various other elevator configurations may be used with the present invention including configurations that do not use a compensation rope and pulley or a counterweight per se, such as a configuration utilizing a linear motor, a two-to-one roping or other scheme, and a double wrapped traction scheme on the drive sheave, just to name a few alternate configurations.

Figure 2:
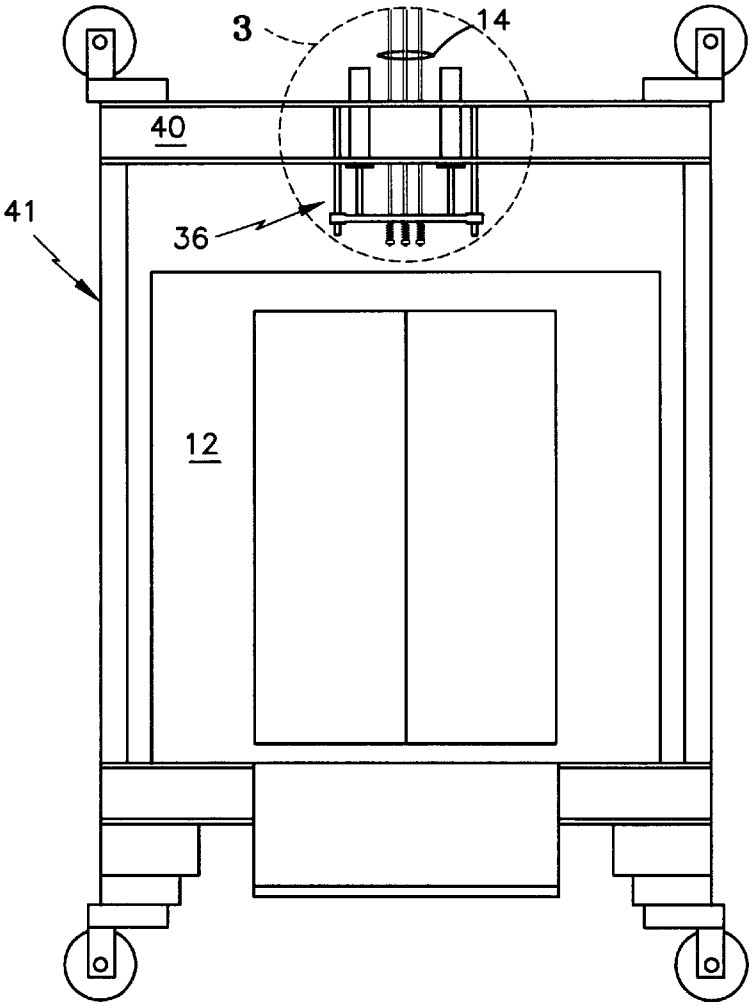
FIG. 2 is a diagram of an elevator car having a semi-active hitch in accordance with the present invention.
Figure 3:
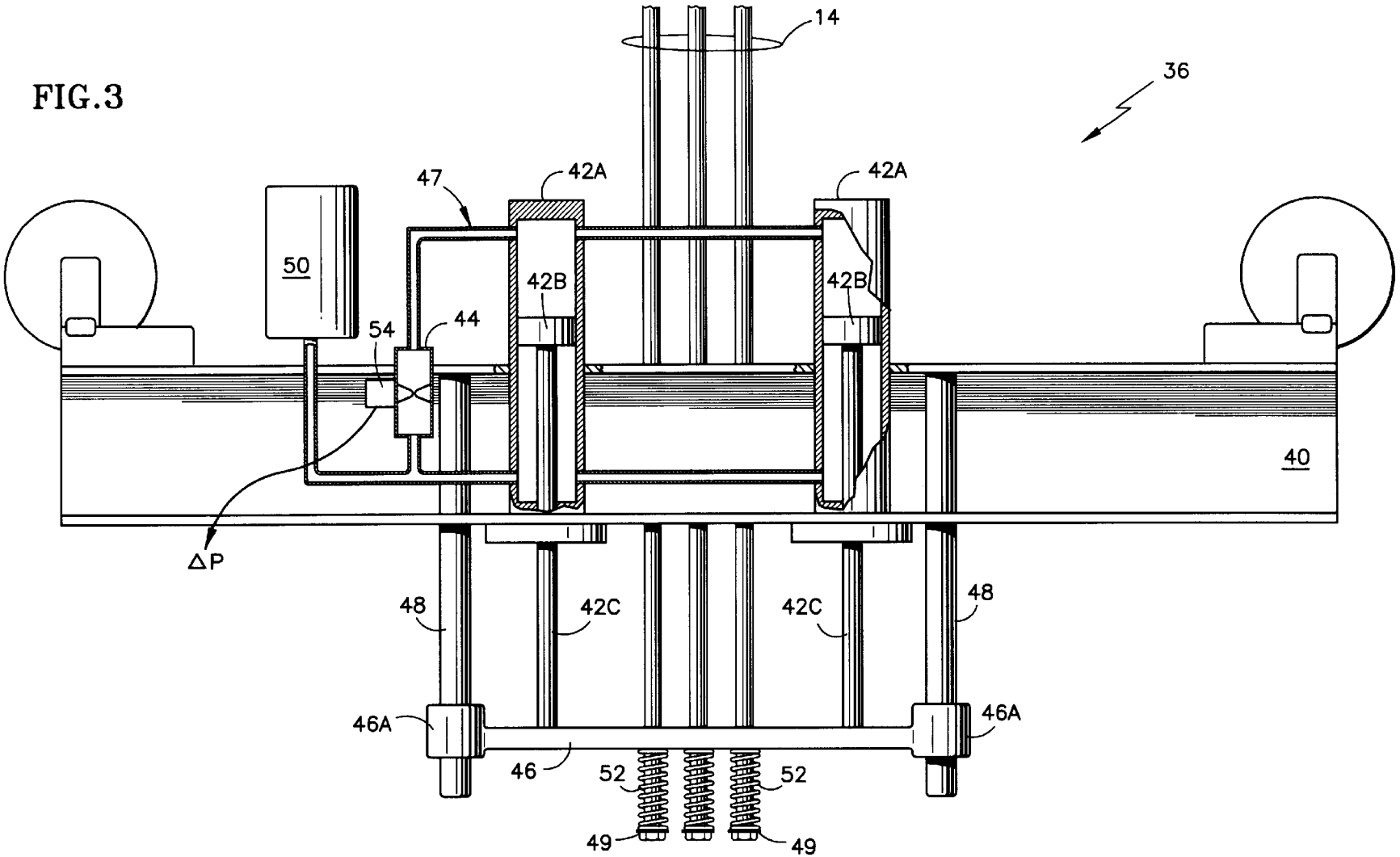
FIG. 3 is an enlarged, more detailed diagram of the semi-active elevator hitch used with the elevator car of FIG. 2.

Referring now to FIG. 2, the elevator car 12 is interconnected to the main rope 14 by a semi-active hitch assembly 36 which is shown in greater detail in FIG. 3. Referring also to FIG. 3, the semi-active hitch assembly 36 provides for the interconnection of the elevator car 12 to the main rope 14. As illustrated in FIG. 3, the main rope may include a plurality of steel cables, e.g., three (3) steel cables, which are interconnected to the elevator car 12 via the semi-active hitch assembly 36. In the illustrated example, the main rope 14 passes through a support plate 40 and a hitch 46 and is attached to rope terminators 49. The support plate 40 may be a separate plate, or, as depicted here, it may form part of the elevator frame 41. Positioned between the terminators 49 and the hitch plate 46 are a plurality of passive hitch spring elements 52. In the illustrated example, the passive hitch spring elements 52 positioned between the hitch plate 46 and terminators 49 each have one of the steel ropes which make up the main rope 14 passing therethrough. The passive hitch spring elements 52 provide even tension among the steel ropes which make up the main rope.

Positioned between the hitch plate 46 and the support plate 40 is the semi-active hitch assembly 36, which includes a pair of cylinders 42A and pistons 42B and a variable orifice valve 44 connected in a hydraulic circuit 47. The hydraulic circuit 47 connects the opposite ends of the cylinders 42A. The hydraulic circuit 47 additionally is connected to a gas-pressurized accumulator 50, such that the accumulator 50 and the cylinders 42A and pistons 42B serve as a passive gas hitch spring connected in parallel with the semi-active hitch assembly.

The cylinders 42A are fixedly mounted to the support plate 40 and may typically extend therethrough because of their length, which may be greater than 20 inches. Similarly, the pistons 42B and their associated piston rods 42C are in continuous engagement with and are preferably affixed to, the hitch plate 46. The hitch plate 46 is positioned below the support plate 40 and thus is urged relatively toward (upward) plate 40 by the weight of the elevator car 12 and frame 41 relative to the rope 14 and also by springs 52. The hitch plate 46 includes linear bearings 46A at opposite ends which slide on a respective pair of guide rails 48 which depend, in cantilever fashion, from the support plate 40.

The accumulator 50 is connected to the hydraulic circuit 47 at a location between the variable orifice valve 44 and the lower ends of the cylinders 42A. Although it could be connected between the orifice valve 44 and the upper ends of the cylinders 42A, the former arrangement is preferred because more fluid passes through the valve. The accumulator 50 is prepressurized with nitrogen gas or the like, to a pressure sufficient to apply a pressure to the hydraulic circuit 47 such that the pistons 42B are normally biased to a mid-range position in the cylinders and thereby serve as a soft spring for providing an initial "lifting" force to the elevator car 12 relative to the cable 14.

The variable orifice valve 44 may be any of a variety of types which respond directly or indirectly to a signal to control the size of the orifice and thus the hydraulic impedance of the circuit 47. In the illustrated embodiment, the variable orifice valve 44 may include a linear or rotary element which responds to a linear or rotary stepper motor (not shown) to relatively close or open the orifice. Other mechanisms may also be used, such as an electrically deformable element to control the orifice.

By selectively controlling the size of the orifice in the orifice valve 44, it is possible to regulate the impedance of the hydraulic circuit 47 and thereby regulate or controllably damp the stroke of pistons 42B in their cylinders 42A against the vertical forces acting relatively between the elevator car 12 and the rope 14. In this way, transitory forces acting relatively either upwardly or downwardly on the elevator cab 12 relative to the rope 14 via the semi-active hitch assembly 36 may be resisted.

As mentioned, the gas spring provided by the accumulator 50 is designed to be relatively "soft", and may have a spring constant less than half that of rope 14. This is done to ensure that the hitch stroke remains in phase with the oscillatory motion of the elevator car 12. In this way the semi-active hitch assembly 36 may be controlled to resist or damp relatively low frequency (i.e., less than about 5 Hz) oscillatory motion of the elevator car 12 and rope 14. Thus, the cylinders 42A/pistons 42B and valve 44 are required only to dissipate energy, and there is no requirement to actively drive or power them. This, then, avoids the need for a separate significant energy source at the elevator car 12 or frame 41, except for a relatively small and simple driver to control the orifice of orifice valve 44.

Referring further to FIG. 3, a pressure sensor 54 is operatively connected to the hydraulic circuit 47 at opposite ends of the variable orifice valve 44 to develop and provide an electrical signal, $\Delta P$, representative of the pressure difference across the valve's orifice. This signal is reflective of the force gradient or tension, across the orifice valve 44 and is used in the control algorithms as will be hereinafter explained.

To further appreciate the operation of the damping system formed by the variable orifice valve 44, the pistons 42B and the cylinders 42A and the gas spring formed by the accumulator 50, it is useful to understand the force relationships in the system. The "downward" force on a piston 42B is the product of the "upper" hydraulic pressure, $P_U$, and the area, $A_C$, of the cylinder. Similarly, the "upward" force on that piston is the product of the "lower" hydraulic pressure $P_L$ and the net area, which is the area, $A_C$, of the cylinder minus the area, $A_R$, of the piston rod 42C. Thus, $P_U A_C - P_L(A_C - A_R)$ represents the opposing forces on the opposite faces of piston 42B. That expression may be resolved into a damping component, $(P_U - P_L)A_C$, and a spring component, $P_L A_R$.

Figure 4:
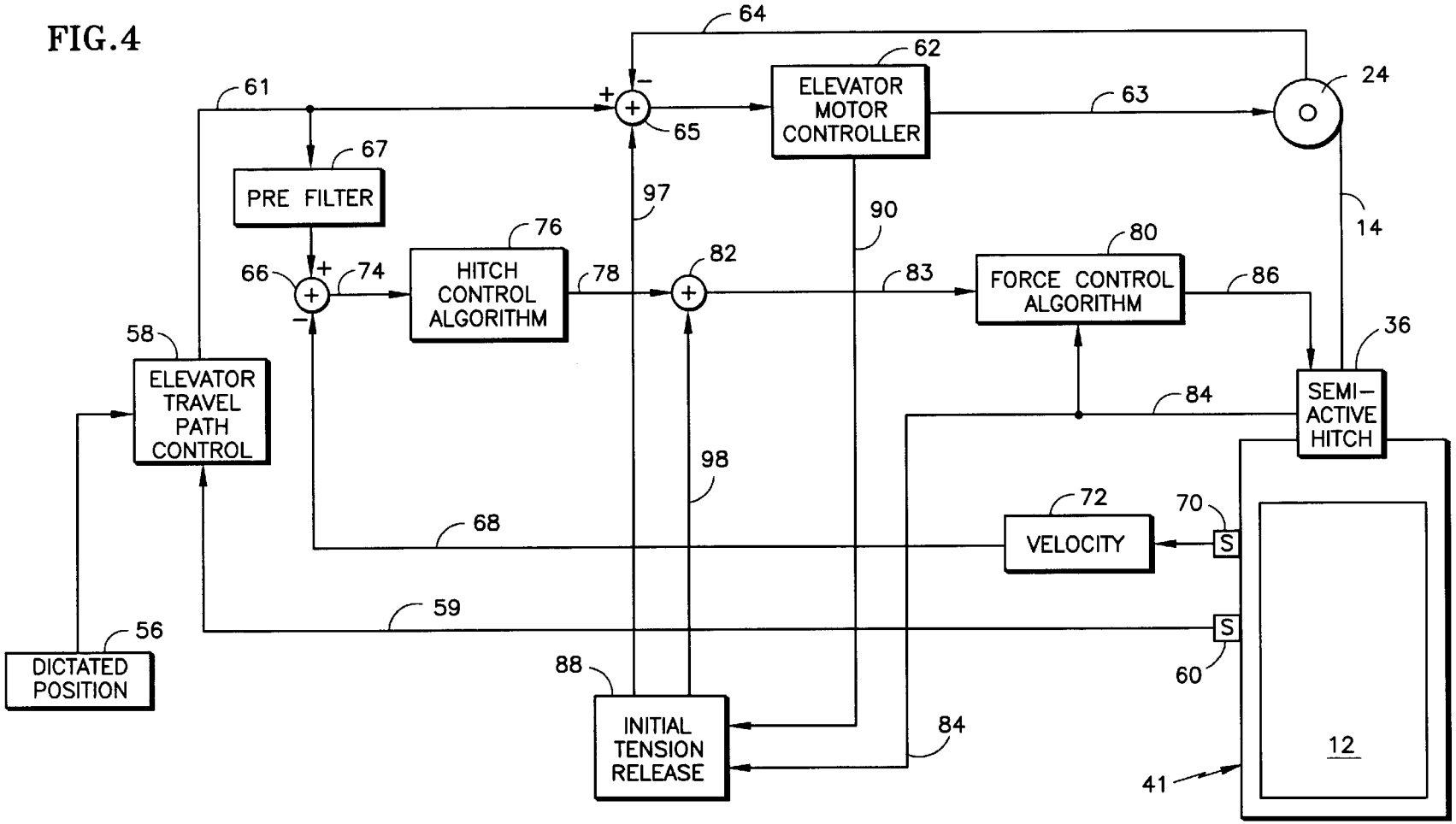
FIG. 4 is a schematic block diagram of a control system for controlling an elevator motor and semi-active elevator hitch in accordance with the invention.

Reference is now made to FIG. 4 which depicts the control system which may be used for controlling the elevator motor and also, importantly, the semi-active elevator hitch of the invention. A signal representative of a desired or dictated position of the elevator car 12 is provided by the signal source 56, and serves as an input to an elevator travel path controller 58. The elevator travel path controller 58 generates control signals in accordance with a dictated travel profile for controlling the elevator motor 28 (therefore sheave 24) and the variable orifice valve 44 (FIG. 3) of the damping system associated with the semi-active hitch assembly 36. A further input to the elevator travel path controller 58 is a feedback signal on the line 59 from the position sensor 60 which indicates the position, and thus the controlled response, of the elevator car 12. Position sensor 60 is mounted on frame 41, though it might also be mounted on the car 12 or other elements that move with the car and frame.

The elevator travel path controller 58 provides a motion command signal on line 61 which is extended to an elevator motor controller 62, via a summer 65. The motion command signal on line 61 typically commands a velocity, though it might alternatively involve other parameters. The elevator motor controller 62 provides control signals on the line 63 to the elevator motor 28 for controlling the speed of the elevator motion (FIG. 1), and therefore sheave 24, to implement the motion command signal. The control response of the elevator motor 28 (FIG. 1) and/or sheave 24 to the signals provided on line 63 is provided as feedback on the line 64 to another input to summer 65 in the way known in the art for controlling the speed of the elevator motor 28 (FIG. 1).

The motion command signal on line 61 is additionally extended to the control circuitry for the semi-automatic hitch assembly 36. Specifically, the motion command signal on line 61 is extended through a lag prefilter 67 to summer 66 where it is arithmetically summed or compared with a velocity feedback signal on line 68. The lag prefilter 67 introduces a delay to simulate the delay in rope 14. The velocity feedback signal on line 68 is representative of the velocity (rate and direction) of motion of the elevator car 12/frame 41, and is provided by a sensor 70 mounted thereon. The sensor 70 typically is an accelerometer or the like, the output of which may be integrated, as at integrator 72, to provide the rate or velocity signal on line 68.

The motion command signal on line 61 is indicative of a commanded direction of travel and, to some extent, the velocity commanded. That signal, after modification by comparison at summer 66 with the actual velocity/direction signal being fed back on line 68, results in an error signal on line 74 which is extended to a hitch control algorithm circuit 76, where it is appropriately scaled by a gain. The resulting signal from the hitch control algorithm circuit 76 represents the damping component of the force to be applied by the semi-active hitch assembly 36 scaled down by cylinder area to be in terms of pressure across the variable orifice valve 44 and is extended on line 78 to summer 82, and from the output of summer 82 on line 83 to force control algorithm circuitry 80. Further, the pressure difference ΔP across variable orifice valve 44 (FIG. 3), as measured by the pressure differential sensor 54 (FIG. 3), is fed back via line 84 to the force control algorithm circuitry 80.

The force control algorithm circuitry 80 treats the input command signal on line 83 as a measure of the desired or commanded pressure differential value ΔPc, and translates that to a commanded opening area of the orifice in the variable orifice valve 44 in accordance with:

$$\text{Area command}=\text{Area}*\text{sq. root}(\Delta P/\Delta Pc)+Kv*(|\Delta P|31\ |\Delta Pc|)$$

when $$\Delta P/\Delta Pc>0$$

and maximum area when $$\Delta P/\Delta Pc\leqq 0,$$

each where ΔP is the actual measured pressure difference across the variable orifice valve 44 and ΔPc is the commanded pressure difference as a function of the motion command signal on line 61 as modified by summer 66 and the hitch control algorithm circuit 76. The resulting area command signal is further translated, by a lookup table associated with the force control algorithm circuitry 80, into a valve drive motor command signal appearing on line 86.

The valve drive motor command signal on line 86 is extended to a small stepper motor or the like (not shown) which adjusts the orifice area of the variable orifice valve 44.

The variable orifice valve 44 is at a limit position, in this instance closed, during passenger loading and unloading when the initial motion command signal indicates that no motion should occur. This is to ensure that the semi-active hitch assembly 36, and particularly the cylinders 42A and cylinders 42B, remain in fixed relative positions to maintain positional accuracy. However, this implies that at the next start-up of the elevator car 12 by the control system, there will probably be some initial tension or pressure difference across the variable orifice valve 44 because passengers have entered or left the elevator. Thus, in accordance with a further aspect of the invention, the control circuitry further includes provision for gradually releasing any such tension across the variable orifice valve 44 to minimize an abrupt, or jerky, start up of the elevator car 12.

Figure 5:
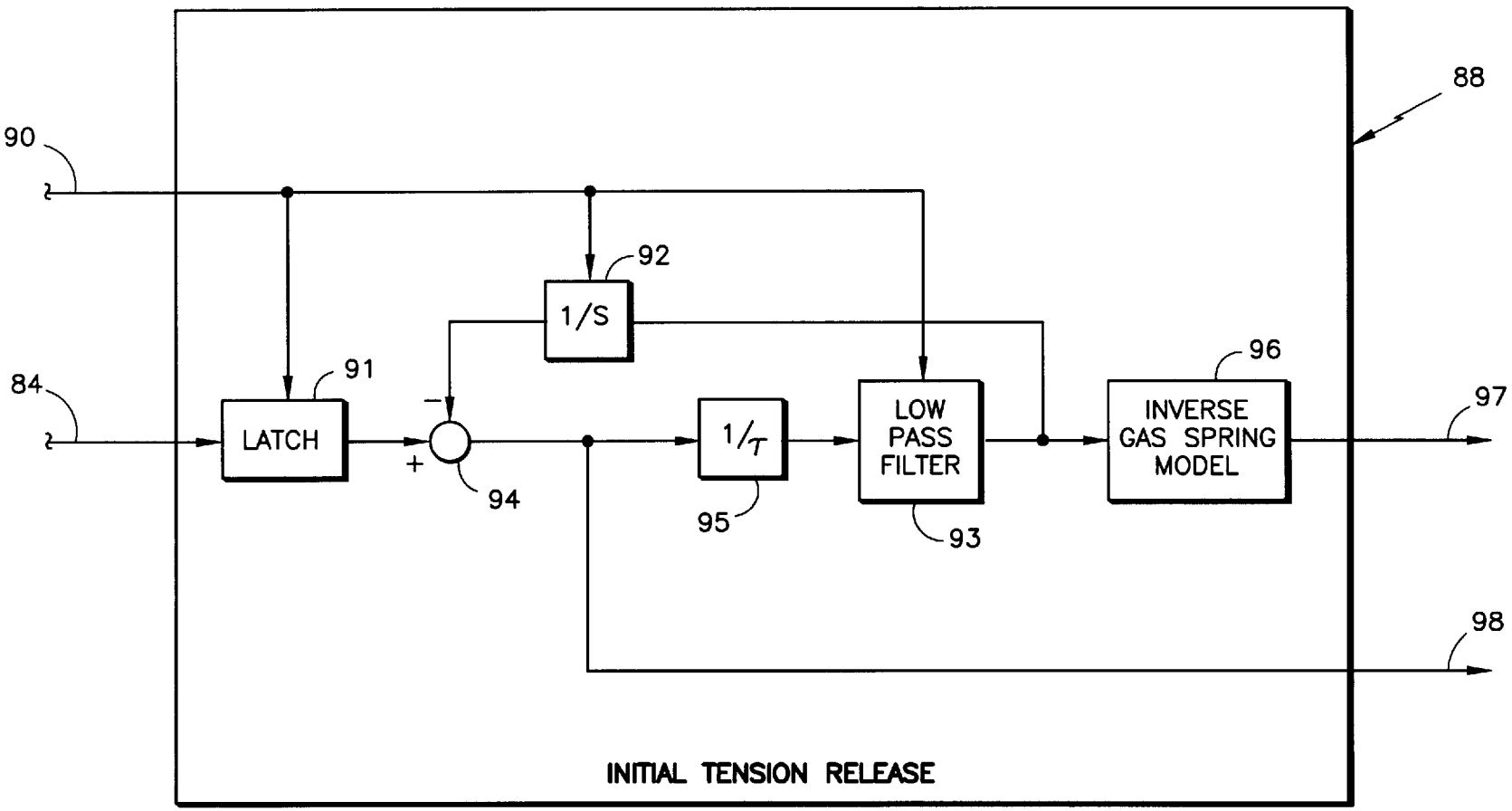
FIG. 5 is a more detailed schematic block diagram of an initial tension release function of the control system of FIG. 4.

Specifically, the control system includes initial tension release control circuitry 88, shown in greater detail in FIG. 5, having an input signal on line 90 from the elevator motor controller 62 and an input signal on line 84 representative of the actual pressure difference, ΔP, across the variable orifice valve 44. The signal on line 90 is representative of the elevator motor brake being released. The brake is normally actuated during the interval that the elevator car 12 is programmed to be stopped, and is released at start up and during travel. The ΔP signal on line 84 is input to a latch 91. The brake release signal on line 90 is also applied to latch 91 to trigger the latching of the ΔP valve. Similarly, the brake release signal on line 90 extends to and initializes an integrator 92 and a low pass filter 93. The latched value of ΔP is extended to an arithmetic summer 94, the output of which is scaled by time constant element 95 and thence is applied as the input to low pass filter 93. The output of low pass filter 93 is fed back through integrator 92 to provide the other input to summer 94. In this way, the low pass filter 93 and integrator 92 serve, in effect, as a high pass filter with respect to the output from summer 94. The output from low pass filter 93 is extended to an inverse gas spring model function 96, which in turn provides a resulting signal on line 97 to provide an input to summer 65 to indicate the elevator car velocity as a result of brake release. This indication is used to bias the motor velocity command so that the motor 28 and sheave 24 move counter to the hitch gap motion so that no net car movement results from tension release. Similarly, the output of summer 94 is extended on line 98 to provide the other input to summer 82, and is a function of the measured ΔP at the variable orifice valve 44 to aid in providing the appropriate control signal on line 86 to the orifice valve for the initial period following brake release. In this way, the initial tension release function 88 ensures a gradual release of the tension across valve 44 and an appropriate adjustment to the motion command applied to the elevator motor 28.

Viewing over all operation of the elevator car 12 through use of its control system and the semi-active hitch assembly 36, performance is significantly improved, particularly in long hoistways, relative to a system with no active hitch. Differences between the commanded car 12 velocity and the velocity of car 12 resulting from the controlled motor 28 acting through the rope 14 are attenuated via the car feedback control loop. By feeding back car velocity, with respect to the hoistway, to effect a force on the car 12, albeit a damping force, the damping of the oscillatory modes is greatly increased, essentially eliminating the oscillations. This is a very robust form of damping (i.e., it will perform well in spite of unknown changes in car mass and rope compliance) because the force is applied at the same point in the system (semi-active hitch assembly 36) where the rate is measured (frame 41, car 12).

In accordance with the present invention, the control of the variable orifice valve 44 is of such timing and quantity as to resist and damp otherwise undesirable oscillatory excursions, whether relatively upward or downward, from the programmed travel profile. Because this is a damping function and thus is only semi-active, the control of the damping mechanism, e.g., the variable orifice valve 44, requires only a relatively small amount of energy and may be accomplished relatively quietly.

Simulation analysis shows that two 4 inch diameter cylinders 42A with the pistons 42B having 24 inch strokes and 2 inch diameter piston rods 42C combined with a 6 inch diameter by 10 inch long accumulator 50 can decrease travel time for a 267 meter run from 44 to 36 seconds and smooth the ride, relative to a system having no form of active or semi-active hitch control. A 6900 Kg gross weight (elevator car 12, passengers, and frame 41) elevator was simulated.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A system for semi-active damping of oscillations during vertical motion of an elevator car position along an elevator travel path, the elevator car being connected by a rope to a sheave mounted to an elevator motor, the rope being connected to the car in a manner permitting limited relative vertical motion therebetween, the system comprising:

means for providing a motion command signal which corresponds with an elevator travel profile dictated by a desired destination of the elevator along the elevator travel path;

spring means effectively connected between the rope and the elevator car to provide a vertical spring force therebetween;

controllable damping means effectively connected between the elevator car and the rope in parallel with the spring means, the damping means being responsive to a damping command signal for selectively impeding relative vertical displacement between the elevator car and the rope;

means for measuring the vertical velocity of the elevator car and providing a signal indicative thereof; and control means responsive to the motion command signal and to the car velocity signal for providing a damping command signal to the controllable damping means to selectively activate the controllable damping means.

2. The system of claim 1 wherein said spring means has a spring constant sufficiently low that it is relatively soft, thereby to ensure that relative vertical travel of the elevator car and relative vertical travel between the elevator car and the rope remain in phase with one another at the relatively low frequency of elevator car and rope oscillations.

3. The system of claim 2 wherein the spring constant of said spring means is less than one-half the spring constant of said rope.

4. The system of claim 2 wherein the elevator car is connected to the rope via a hitch assembly, the hitch assembly comprising a support member interconnected to the elevator car and a hitch plate engaged by the rope and movable relative to the support member, and wherein the controllable damping means engages the support member and the hitch plate to controllably damp relative motion therebetween.

5. The system of claim 4 wherein the controllable damping means comprises at least one hydraulic piston and cylinder combination operatively connecting the support member and the hatch plate, a hydraulic circuit for supplying hydraulic fluid to and from the cylinder on opposite sides of the piston, and a variable orifice valve connected in the hydraulic circuit for regulating the flow of hydraulic fluid therethrough in response to the damping command signal to thereby impede relative vertical motion between the elevator car and the rope.

6. The system of claim 5 wherein said spring means comprises an hydraulic accumulator, said accumulator being hydraulically connected to said hydraulic circuit and having a gas precharge, and being sized and pressurized to establish said spring constant in the hydraulic circuit.

7. The system of claim 1 wherein said means for measuring the vertical velocity of the elevator car is structured and positioned to provide a direct indication of the vertical velocity of the elevator car.

8. The system of claim 5 wherein said control means responds to said motion command signal and said car velocity signal to provide a command signal for controlling the orifice area of the variable orifice valve, thereby to control the damping force for impeding relative vertical displacement between the elevator car and the rope.

9. A system for semi-active damping of oscillations during vertical motion of an elevator car position along an elevator travel path, the elevator car being connected by a rope to a sheave mounted to an elevator motor, the rope being connected to the car in a manner permitting limited relative vertical motion therebetween, the system comprising:

means for providing a motion command signal which corresponds with an elevator travel profile dictated by a desired destination of the elevator along the elevator travel path;

spring means effectively connected between the rope and the elevator car to provide a vertical spring force therebetween, said spring means has a spring constant sufficiently low that it is relatively soft, thereby to ensure that relative vertical travel of the elevator car and relative vertical travel between the elevator car and the rope remain in phase with one another at the relatively low frequency of elevator car and rope oscillations;

controllable damping means effectively connected between the elevator car and the rope in parallel with the spring means, the damping means being responsive to a damping command signal for selectively impeding relative vertical displacement between the elevator car and the rope;

means for measuring the vertical velocity of the elevator car and providing a signal indicative thereof;

control means responsive to the motion command signal and to the car velocity signal for providing a damping command signal to the controllable damping means to selectively activate the controllable damping means;

the elevator car is connected to the rope via a hitch assembly, the hitch assembly comprising a support member interconnected to the elevator car and a hitch plate engaged by the rope and movable relative to the support member, and the controllable damping means engages the support member and the hitch plate to controllably damp relative motion therebetween; and the controllable damping means comprises at least one hydraulic piston and cylinder combination operatively connecting the support member and the hatch plate, a hydraulic circuit for supplying hydraulic fluid to and from the cylinder on opposite sides of the piston, and a variable orifice valve connected in the hydraulic circuit for regulating the flow of hydraulic fluid therethrough in response to the damping command signal to thereby impede relative vertical motion between the elevator car and the rope.

10. The system of claim 9 further including means responsive to release of the brake signal and to a signal indicative of the pressure difference across the variable orifice valve for providing an initial tension release signal, for controlling the rate at which the limit damping force is released.

11. A system for semi-active damping of oscillations during vertical motion of an elevator car position along an elevator travel path, the elevator car being connected by a rope to a sheave mounted to an elevator motor, the rope being connected to the car in a manner permitting limited relative vertical motion therebetween, the system comprising:

means for providing a motion command signal which corresponds with an elevator travel profile dictated by a desired destination of the elevator along the elevator travel path;

spring means effectively connected between the rope and the elevator car to provide a vertical spring force therebetween;

controllable damping means effectively connected between the elevator car and the rope in parallel with the spring means, the damping means being responsive to a damping command signal for selectively impeding relative vertical displacement between the elevator car and the rope;

means for measuring the vertical velocity of the elevator car and providing a signal indicative thereof;

control means responsive to the motion command signal and to the car velocity signal for providing a damping command signal to the controllable damping means to selectively activate the controllable damping means; and means for providing a brake signal when an elevator brake is applied, and wherein said control means is further responsive to the brake signal to provide a limit damping command signal and said controllable damping means is responsive to said limit damping command to apply a limit damping force sufficient to prevent relative vertical motion between the elevator car and rope.

* * * * *